US005816060A

United States Patent [19]

Brownell et al.

[11] Patent Number: 5,816,060

[45] Date of Patent: Oct. 6, 1998

[54] AIR FLOW CONTROL IN A SIDE-BY-SIDE REFRIGERATOR

[75] Inventors: Thomas Arthur Brownell, Charlton, N.Y.; Robert Leonard Fulks, Goshen, Ky.; Joanna Marie Diederich, Louisville, Ky.; Rollie Richard Herzog, Louisville, Ky.; John August Sedovic, Wichita, Kans.

[73] Assignee: General Electric Company, Schenectady, N.Y.

[21] Appl. No.: 773,204

[22] Filed: Dec. 23, 1996

[51] Int. Cl.[6] ..... F25D 17/08

[52] U.S. Cl. ..... 62/186; 62/413

[58] Field of Search ..... 62/186, 413, 407, 62/419, 426, 441

[56] References Cited

U.S. PATENT DOCUMENTS

| | | | |
|---|---|---|---|
| 2,546,363 | 3/1951 | Jaeger | 62/186 |
| 3,122,005 | 2/1964 | Constantini et al. | 62/419 |
| 3,359,751 | 12/1967 | Stevens | 62/186 |
| 3,403,533 | 10/1968 | Bollenbacher | 62/441 |
| 3,609,988 | 10/1971 | Bright | 62/419 |
| 4,732,009 | 3/1988 | Frohbieter | 62/441 |
| 5,355,686 | 10/1994 | Weiss | 62/186 |
| 5,642,628 | 7/1997 | Whipple, III et al. | 62/186 |

*Primary Examiner*—William E. Tapoicai
*Attorney, Agent, or Firm*—Donald S. Ingraham; Douglas E. Stoner

[57] ABSTRACT

An air flow control arrangement for a side-by-side refrigerator which results in temperature variations, both spatial and temporal, of approximately about ±1° F. in the fresh food compartment, is described. Such air flow control also is believed to even further reduce the internal "sweat" in the fresh food compartment. In one embodiment, and with respect to a side-by-side refrigerator, the middle duct in the center mullion wall is closed off, and a duct is added in the center mullion wall, or could be installed as a separate duct outside the mullion, connecting a supply port in the top, back, left hand corner in fresh food compartment to a position in the evaporator chamber. The added duct also seals off direct airflow between the evaporator chamber and the fresh food compartment. An auxiliary air flow control fan located in a port in the center mullion wall controls air flow through the fresh food compartment, and ducts located in a middle portion of the center mullion wall are provided to allow cool air in freezer compartment to flow into fresh food compartment. Manually set dampers may be located in these ducts to control the amount of air flow from the freezer compartment to the fresh food compartment. Cool freezer air also may flow through the center mullion wall lower duct into the fresh food compartment.

16 Claims, 3 Drawing Sheets

AIR FLOW CONTROL IN A SIDE-BY-SIDE REFRIGERATOR

FIELD OF THE INVENTION

This invention relates generally to refrigerators and, more particularly, to controlling air flow in a side-by-side type refrigerator.

BACKGROUND OF THE INVENTION

Household refrigerators generally utilize a simple vapor compression cycle for cooling air. Such a cycle includes a compressor, a condenser, an expansion device, and an evaporator connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator compartments.

A typical household side-by-side refrigerator includes a freezer storage compartment and a fresh food storage compartment arranged side-by-side and separated by a center mullion wall. Shelves and drawers typically are provided in the fresh food compartment, and shelves and wire baskets typically are provided in the freezer compartment. In addition, an ice maker may be provided in the freezer compartment. A freezer door and a fresh food door close the access openings to the freezer and fresh food compartments, respectively.

An evaporator chamber typically is located in the freezer compartment, and the evaporator chamber is substantially separated from the food storage portion of the freezer compartment by an evaporator chamber wall. The evaporator is located in the evaporator chamber, and a fan typically is located near an opening in an upper portion of the evaporator chamber wall. In operation, the fan draws air up through the evaporator chamber and injects cooled air into the food storage portion of the freezer compartment. Because the fan creates a pressure differential between the top and bottom of the evaporator, the cooled air at the fan exit is also supplied to the fresh food compartment by a duct which is located at the top rear portion of the fresh food compartment with a return duct at the bottom of the evaporator chamber.

Cooled air also is supplied to the fresh food compartment through a lower duct in a lower portion of the center mullion wall. Specifically, cool air from the freezer compartment passes into the fresh food compartment through the lower duct in the center mullion wall. Since the fresh food compartment air typically is warmer than the freezer compartment air, the cooler freezer air naturally flows into the fresh food compartment through the lower duct.

In addition, a duct extends through a middle portion of the center mullion wall and is in air flow communication with the fresh food compartment and the evaporator chamber. Warmer air in the fresh food compartment is drawn into the duct by the pressure differential caused by the evaporator chamber fan, and the warm fresh food compartment air flows through the duct and into the evaporator chamber. The warm fresh food compartment air is then cooled by the evaporator and is passed into the fresh food compartment and the food storage portion of the freezer compartment as described above.

With the above described air flow configuration, temperature variations of ±4° F. or more may exist between any point in the food storage portion of the fresh food compartment and the spatial average for the food storage portion of the fresh food compartment, or as measured at any one point in the food storage portion of the fresh food compartment over time. Although such temperature variations are acceptable, spatial or temporal temperature variations of ±1° F. are desirable for food preservation.

The air flow path described above also results in cooler air entering the fresh food compartment and settling within the compartment; similarly, relatively warm and humid air in the fresh food compartment tends to rise, resulting in possible temperature differential across surfaces in the compartment (such as shelves) that can result in the formation of condensation (or sweating) on the surfaces adjacent to the warm and humid air.

In the past, to control the differential temperature between the freezer compartment and fresh food compartment, a manual damper was located in the opening in the evaporator chamber wall. By selecting a position for the damper, the relative amount of cool air passed from the freezer compartment into the fresh food compartment could be controlled. For example, as the damper was moved closer to a fully closed position, less cooled air was passed into the fresh food compartment, and as the damper was moved closer to a fully open position, more cooled air was passed into the fresh food compartment.

To improve temperature control, actuators have been included in side-by-side refrigerators to control the extent of air flow into the fresh food compartments. The actuators typically are thermo-mechanical or electric dampers, and are located in the air ducts between the freezer and fresh food compartments. The actuators are responsive to air temperature, and the amount of air flow allowed through the dampers depends on the temperatures at the actuators.

Although the actuators described above provide acceptable air flow control in side-by-side refrigerators, it would be desirable to even further improve air flow control with respect to the spatial and temporal temperature variations in the fresh food compartment. Particularly, it would be desirable to provide air flow control in a side-by-side refrigerator which achieves temperature variations, both spatial and temporal, of approximately about ±1° F in the fresh food compartment. In addition, it would be desirable to even further reduce the internal "sweat" in the fresh food compartment of the side-by-side refrigerator. Such improved air flow control and reduced sweat preferably would be achieved without adding any significant fabrication costs, in terms of material and labor, to the refrigerator.

SUMMARY OF THE INVENTION

These and other objects are attained by an air flow control arrangement in accordance with the present invention. Specifically, and in accordance with one embodiment of the present invention, the middle duct in the center mullion wall is closed off, and a duct is added in the center mullion wall, or could be installed as a separate duct outside the mullion, connecting a supply port in an upper back corner in the fresh food compartment to the evaporator chamber. The added duct also seals off direct airflow from the outlet of the evaporator chamber to the fresh food compartment.

In addition, an auxiliary air flow control fan located at the supply port in the upper back corner controls air flow through the fresh food compartment as described hereinafter in more detail. This fan provides the forcing function to move air from the top of the fresh food compartment to the evaporator compartment. Cool air from the freezer compartment then returns to the fresh food compartment through ducts disposed in the mullion. Ducts located in a middle portion of the center mullion wall (and typically being disposed towards the front portion of the mullion) are provided to allow cool air in the freezer compartment to flow into the fresh food compartment. Manually set dampers may be located in these ducts to control the amount of air flow from the freezer compartment to the fresh food compartment. Cool freezer air also may flow through the center mullion wall lower duct into the fresh food compartment.

To provide independent temperature control of fresh food and freezer compartments, two control actuators may be used. For independent control of the freezer compartment, a first actuator is coupled to control operation of the compressor; for independent control of the fresh food compartment, a second actuator is coupled to control operation of the auxiliary air flow control fan.

With respect to the air flow resulting from the arrangement described above, warm air enters into the evaporator chamber from the freezer compartment through the open lower end of the chamber and from the fresh food compartment through the evaporator chamber inlet in the added duct. The air is drawn up through the chamber by the evaporator fan and is cooled by the evaporator. The cooled air is injected into the food storage portion of the freezer compartment by the evaporator fan. Cool freezer compartment air is forced to pass into the fresh food compartment through the various ducts described above to replace the air that is forced through the duct into the evaporator chamber. Air is drawn upward in the fresh food compartment by the added fan, and the warmer fresh food compartment air drawn upward by the added fan is injected into the added duct. The warm fresh food compartment air is then supplied to the evaporator chamber through the added duct, and as described above, the evaporator then cools the warm freezer and fresh food compartment air.

The air flow described above typically results in temperature variations, both spatial and temporal, of approximately about ±1° F. in the fresh food compartment. Such air flow control typically also reduces the internal "sweat" in the fresh food compartment as the warmest air is forced out to the evaporator chamber rather than cold air being forced in at the warmest locations. In addition, such air flow control is not believed to significantly impact the refrigerator fabrication costs, in terms of both labor and materials.

DETAILED DESCRIPTION OF THE DRAWINGS

Figure 1:
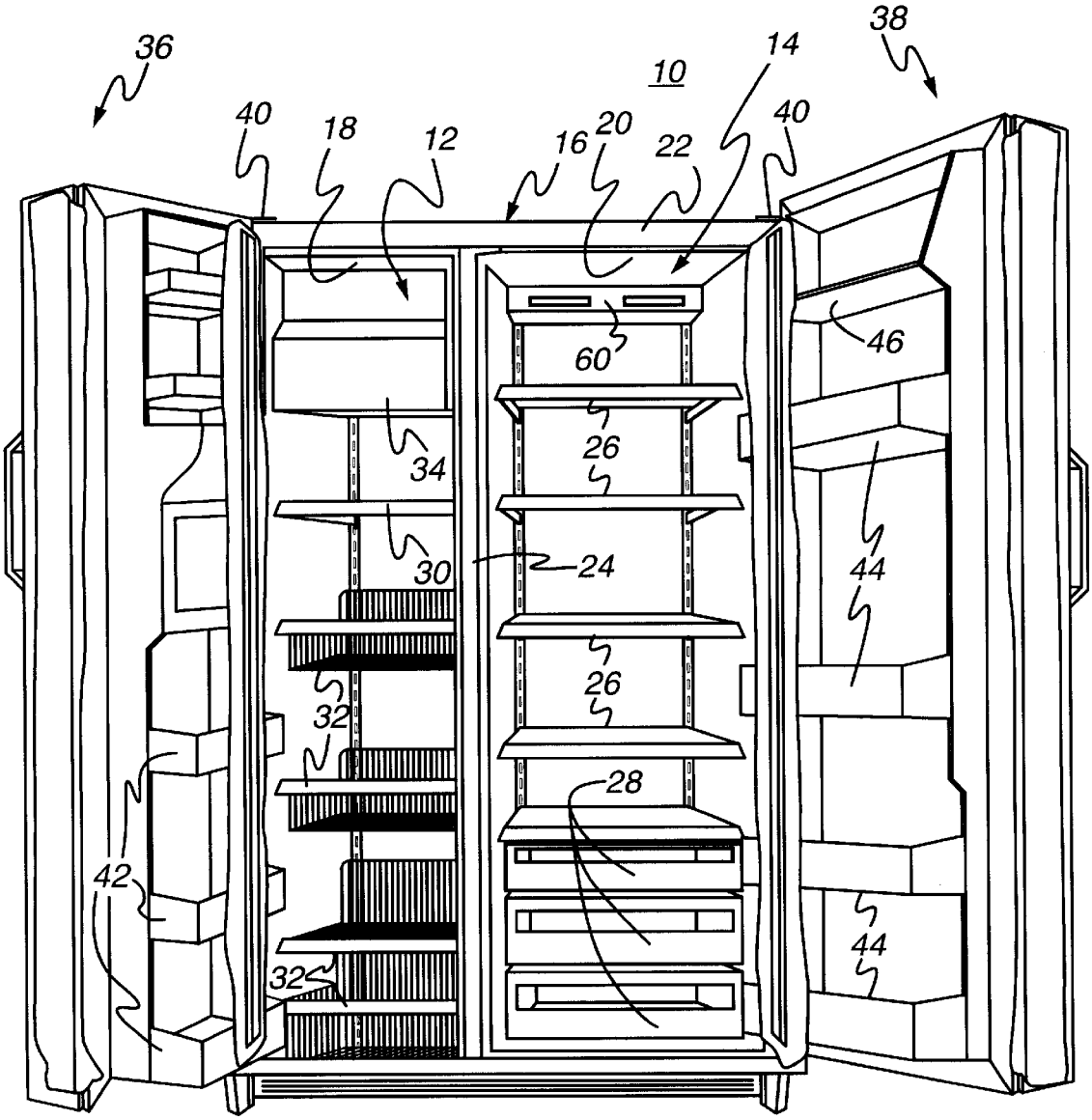
fig. 1 PRIOR ART
FIG. 1 is a front perspective view of a known side-by-side refrigerator with the access doors open.

FIG. 1 is a front perspective view of a side-by-side refrigerator 10 including a freezer storage compartment 12 and a fresh food storage compartment 14. Freezer compartment 12 and fresh food compartment 14 are arranged side-by-side. A side-by-side refrigerator such as refrigerator 10 is commercially available from General Electric Company, Appliance Park, Louisville, KY. 40225.

Refrigerator 10 includes an outer case 16 and inner liners 18 and 20. The space between case 16 and liners 18 and 20, and between liners 18 and 20, is filled with foamed-in-place insulation. Outer case 16 normally is formed by folding a sheet of a suitable material, such as pre-painted steel, into an inverted U-shape to form the top and side walls of case 16. The bottom wall of case 16 normally is formed separately and attached to the side walls and to a bottom frame that provides support for refrigerator 10. Inner liners 18 and 20 are molded from a suitable plastic material to form freezer compartment 12 and fresh food compartment 14, respectively. Alternatively, liners 18 and 20 may be formed by bending and welding a sheet of a suitable metal, such as steel. The illustrative embodiment includes two separate liners 18 and 20 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 22 extends between the case front flange and the outer front edges of liners 18 and 20. Breaker strip 22 is formed from a suitable resilient material, such as an extruded acrylo-butadiene-syrene based material (commonly referred to as ABS).

The insulation in the space between liners 18 and 20 is covered by another strip to suitable resilient material 24, which also commonly is referred to as the mullion. Mullion 24 also preferably is formed of an extruded ABS material. It will be understood that in a refrigerator with a separate mullion dividing an unitary liner into a freezer and a fresh food compartment, the front face member of that mullion corresponds to mullion 24. Breaker strip 22 and mullion 24 form a front face, and extend completely around the inner peripheral edges of case 16 and vertically between liners 18 and 20. Mullion 24, insulation between compartments 12 and 14, and the spaced wall of liners 18 and 20 separating compartments 12 and 14, sometimes are collectively referred to herein as the center mullion wall.

Shelves 26 and drawers 28 normally are provided in fresh food compartment 14 to support items being stored therein. Similarly, shelves 30 and wire baskets 32 are provided in freezer compartment 12. In addition, an ice maker 34 may be provided in freezer compartment 12.

A freezer door 36 and a fresh food door 38 close the access openings to freezer and fresh food compartments 12 and 14, respectively. Each door 36 and 38 is mounted by a top hinge 40 and a bottom hinge (not shown) to rotate about its outer vertical edge between an open position, as shown in FIG. 1, and a closed position closing the associated storage compartment. Freezer door 36 includes a plurality of storage shelves 42, and fresh food door 38 also includes a plurality of storage shelves 44 and a butter storage bin 46.

Figure 2:
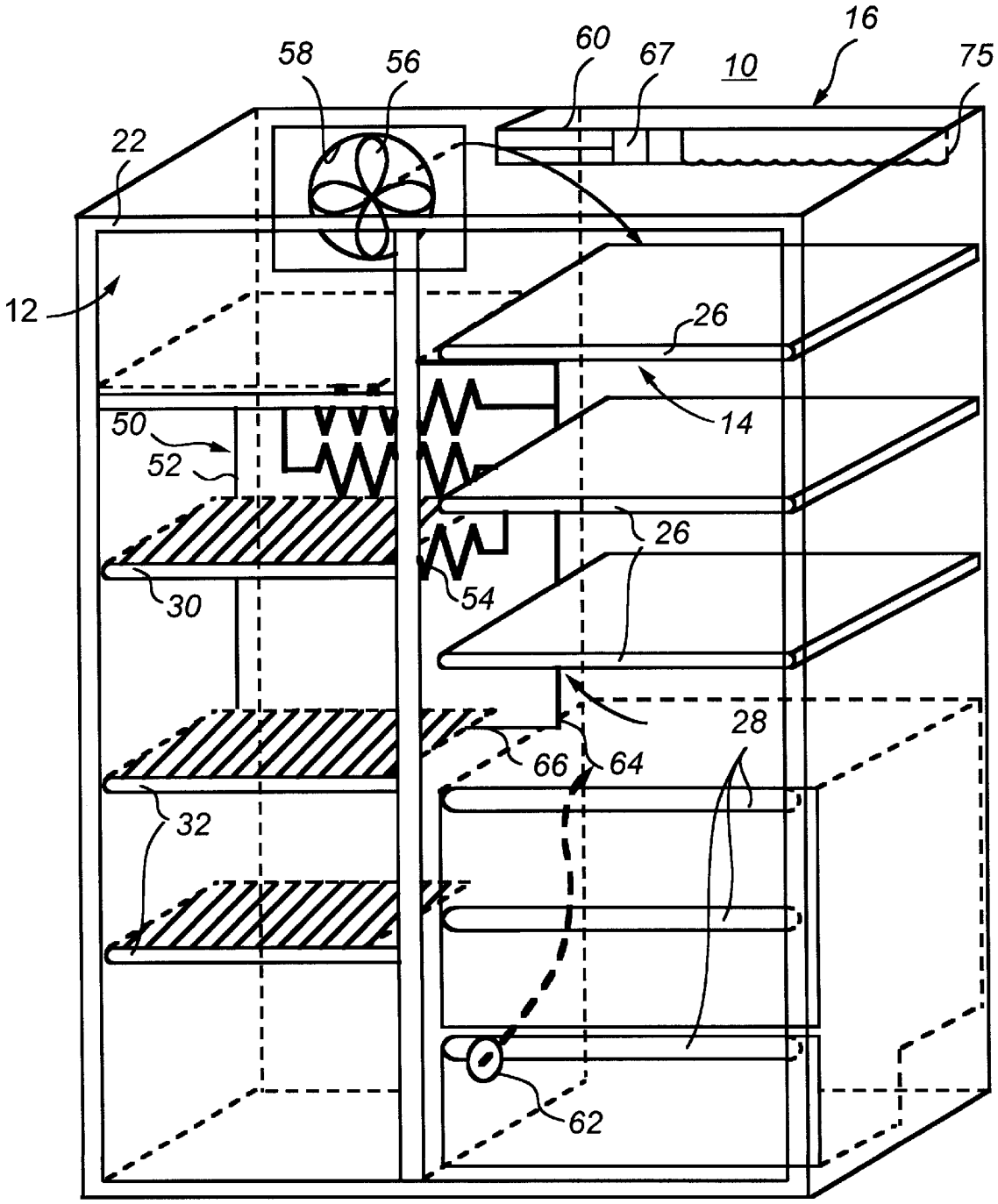
fig. 2 PRIOR ART
FIG. 2 is a schematic illustration of air flow in a known side-by-side refrigerator.

With respect to the flow of air in refrigerator 10, and referring to FIG. 2 which is a schematic illustration of air flow in a side-by-side refrigerator such as refrigerator 10, an evaporator chamber 50 typically is located in freezer compartment 12, and evaporator chamber 50 is substantially separated from the food storage portion of freezer compartment 12 by an evaporator chamber wall 52. An evaporator 54 is located in evaporator chamber 50, and a fan 56 typically is located near an opening 58 in an upper portion of evaporator chamber wall 52. In operation, evaporator fan 56 draws air up through evaporator chamber 50 and injects cooled air into the food storage portion of freezer compartment 12. The cooled air from evaporator chamber 50 also is supplied to fresh food compartment 14 through a duct 60 located at the top rear portion of fresh food compartment 14, in air flow communication with evaporator chamber 50. Of course, in an alternative embodiment, fan 56 could be located in a lower portion of chamber 50 and draw air downward.

Cooled air also is supplied to fresh food compartment 14 through a lower duct 62 in a lower portion of center mullion wall. Specifically, cool air from freezer compartment 12 passes into fresh food compartment 14 through lower duct 62. Since the fresh food compartment air typically is warmer than the freezer compartment air, the cooler freezer air naturally flows into fresh food compartment through lower duct 62.

In addition, a duct 64 extends through a middle portion of the center mullion wall and is in air flow communication with fresh food compartment 14 and evaporator chamber 50. Warmer air in fresh food compartment 14 is drawn into duct 64 by fan 56, and the warm fresh food compartment air flows through duct 64 and into evaporator chamber 50. Warmer air in freezer compartment 12 also is drawn into chamber 50 through an open lower end 66 of chamber 50. The warm freezer and fresh food compartment 12 air is then cooled by evaporator 54 and is passed into freezer compartment 12 and fresh food compartment 14 as described above.

To improve temperature control, an actuator 67 may be used in connection with ducts 60, 62 and 64 to control the extent of air flow into respective compartments 12 and 14. Specifically, the actuators may include thermo-mechanical or electric dampers, may be located in ducts 60, 62 and 64. The amount of air flow allowed through the dampers depends on the temperatures at the actuators. Alternatively, the temperature can be sensed remotely at a location having a temperature representative of the temperature at ducts 60, 62 and 64, and such remotely sensed temperature can be used to remotely control the position of the electric dampers.

Although the actuators described above provide acceptable air flow control in side-by-side refrigerators, it would be desirable to even further improve air flow control with respect to the spatial and temporal temperature variations fresh food compartment 14. Particularly, it would be desirable to provide air flow control in a side-by-side refrigerator which achieves temperature variations, both spatial and temporal, of about ±1° F. It also would be desirable to even further reduce the internal "sweat" in fresh food compartment 14.

Figure 3:
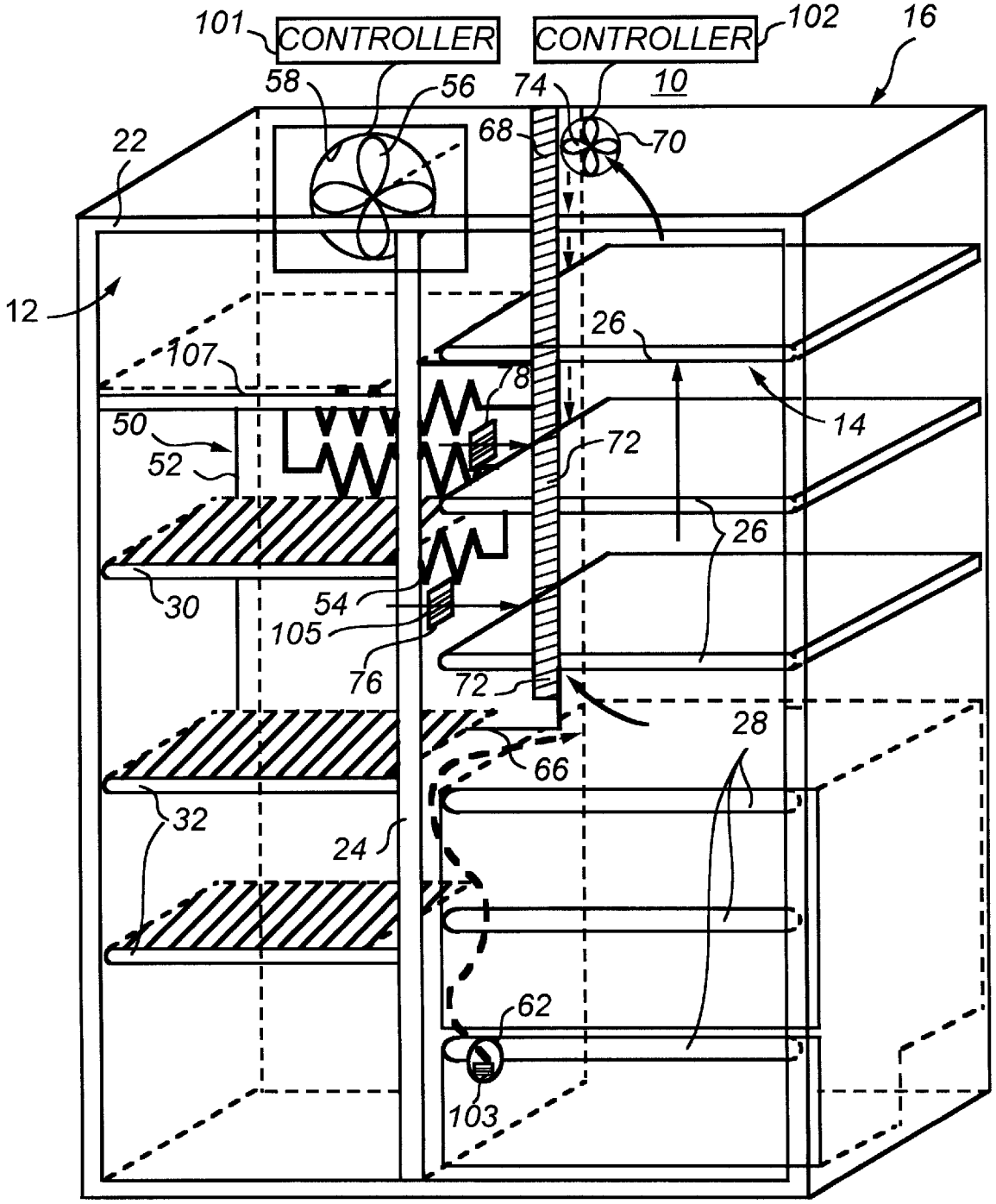
FIG. 3 is a schematic illustration of air flow in a side-by-side refrigerator in accordance with one embodiment of the present invention.

These and other objects are believed to be achieved by an air flow control for a side-by-side refrigerator as illustrated in schematic form in FIG. 3. The air flow control illustrated in FIG. 3 is described herein in reference to the air flow control illustrated in FIG. 2 to explain how an existing and known refrigerator can be easily and readily modified to provide numerous advantages. Therefore, components shown in FIG. 3 which are identical to components shown in FIG. 2 are referenced in FIG. 3 using the same reference numerals as used in FIG. 2.

With respect to the air flow control in present refrigerators, the refrigerator of the present invention differs in that middle duct 64 (see FIG. 2) in center million wall is closed off (or not cut open during fabrication). Duct 64 can be closed off, for example, by using a thin steel plates with insulation extending between the plates in the duct. A duct 68 is added in the center mullion wall, or could be installed as a separate duct outside the mullion, connecting a supply port 70 in the top, back, left hand corner in fresh food compartment 14 to a point within evaporator chamber inlet 50. Duct 68 extends in a generally downward direction from the top area of the refrigerator to a point at least midway down in the evaporator chamber 50, and in some embodiments towards the area of evaporator chamber inlet 72. This orientation of duct 68 serves to prevent convective flow of warm air from fresh food compartment into the top of the evaporator chamber 50 (and thence back into the fresh food compartment through the lower level and mid level ports in the mullion wall). This orientation of duct 68 also serves to deposit the warm and humid air from the fresh food compartment in the lower portion of chamber 50 so as to avoid icing on components disposed near the top of the chamber 50, such as the evaporator fan. Duct 68 also seals off direct airflow from the top of evaporator chamber 50 to the top of fresh food compartment 14.

An auxiliary air flow control fan 74 located in port 70 controls the air flow through fresh food compartment 14 as described hereinafter in more detail. Ducts 76 and 78 in the center mullion wall are provided to allow cool air in freezer compartment 12 to flow into fresh food compartment 14. Manually set dampers may be located in ducts 76 and 78 to control the amount of air flow from freezer compartment 12 to fresh food compartment 14 through ducts 76 and 78. Cool freezer air also may flow through duct 62 into fresh food compartment 14. Air flow through these ducts is forced by the pressure differential (or motive force) created by operation of fan 74.

Independent temperature control of fresh food and freezer compartments is provided by a first control actuator (or controller) 101 that is coupled to control operation of the compressor (and evaporator fan 56) and a second control actuator 102 is coupled to control auxiliary fan 74 by determining the operating periods of the fan. Such control actuators may comprise electronic, electro-mechanical, or mechanical devices such as are used in household appliances to provide a means for actuating a component (such as energizing, and deenergizing, a fan) in response to a predetermined condition (such as a sensed temperature in a compartment). The "on" time of auxiliary fan 74 (that is time, when the fan is operating and generating a differential air pressure) controls air flow through the fresh food compartment and thus provides control of the temperature of this compartment. Typically second control actuator is programmed (such as with a digital processor, or with analog set points in electro-mechanical device) to respond to a sensed temperature signal (from a temperature sensor disposed to sense temperature at a desired location in the refrigerator) so as to selectively energize auxiliary fan 74 to force air flow through the compartment to maintain the sensed temperature within a desired range around a set point temperature.

With respect to the air flow in accordance with the control described above in reference to FIG. 3, air enters into evaporator chamber 50 through open lower end 66 of chamber 50 and through evaporator chamber inlet 72 in duct 68. The air is drawn up through chamber 50 by fan 56 and is cooled by evaporator 54. The cooled air is injected into the food storage portion of freezer compartment 12 by fan 56. Cool freezer compartment air is forced to pass into fresh food compartment 12 through ducts 62, 76 and 78 by the pressure differential created by auxiliary fan 74 (that is, fan 74 draws a suction on the fresh food compartment and thereby draws air into that compartment). Manual dampers 103, 105, 107 disposed respectively in ducts 62, 76 and 78 can be adjusted to control the extent of flow (that is, the flow rate of air) and balance of flow through ducts 62, 76 and 78. Alternatively, control actuators (not shown) are used to control dampers in ducts 62, 76 and 78. Air is drawn upward in fresh food compartment by fan 74, and the warmer fresh food compartment air drawn upward by fan 74 is injected into duct 68. Evaporator 54 then cools the warm freezer and fresh food compartment air, and such cooled air is passed into freezer compartment 12 and fresh food compartment 14 as described above.

The air flow described as controlled by auxiliary fan 74 provides precise temperature control in the fresh food compartment 14, that is, provides air flow through the compartment that enables substantially constant temperature control of the compartment. As used herein, substantially constant temperature control or the like refers to the compartment 14 having temperature variations, both spatial and temporal, of approximately about ±1° F. or less). Air flow controlled by fan 74 also reduces the internal "sweat" in fresh food compartment 14 by maintaining precise temperature control and forcing the movement of air through the compartment. In addition, fan 74 and air flow control as described herein is readily adapted to present refrigerator structures and fabrication procedures so as to not significantly impact the refrigerator labor and material costs for fabrication.

From the preceding description of the present invention, it is evident that the objects of the invention are attained. Although the invention has been described and illustrated in detail, it is to be clearly understood that the same is intended by way of illustration and example only and is not be taken by way of limitation. Accordingly, the spirit and scope of the invention are to be limited only by the terms of the appended claims.

What is claimed is:

1. A side-by-side refrigerator having substantially constant spatial and temporal temperature control, the refrigerator comprising:

a freezer compartment comprising a food storage portion and an evaporator chamber, said evaporator chamber comprising and inlet and an outlet;

a fresh food compartment;

a center mullion wall separating said freezer compartment and said fresh food compartment having a fresh food compartment port formed in an upper portion of said center mullion wall;

a first duct in flow communication with said fresh food compartment port and said evaporator chamber;

an auxiliary air flow control fan disposed to draw a suction on said fresh food compartment and exhaust into said first duct, said first duct being in flow communication with said fresh food compartment port and said evaporator chamber, and said first duct being disposed so as to direct air passing from said fresh food compartment into said evaporator chamber in a downward direction from the top of said refrigerator so as to reduce convective air flow between said fresh food compartment and said evaporator chamber; and a controller coupled to said auxiliary air flow control fan so as to control operation of said fan in correspondence with a sensed temperature in said fresh food compartment so as to provide substantially constant spatial and temporal temperature control in each of said fresh food and freezer compartments.

2. A side-by-side refrigerator in accordance with claim 1 further comprising a lower second duct in a lower portion of said center mullion wall, said lower second duct in flow communication with said food storage portion of said freezer compartment and said fresh food compartment, and further comprising a damper located in said lower second duct for controlling air flow therethrough.

3. A side-by-side refrigerator in accordance with claim 1 further comprising a temperature sensitive actuator coupled to an evaporator fan, operation of said evaporator fan being based on sensed freezer temperature independent of operation of said auxiliary air flow control fan.

4. A side-by-side refrigerator in accordance with claim 1 wherein said auxiliary fan control actuator actuates the auxiliary fan so as to maintain temperature within said fresh food compartment within a temperature range of about 1° F. of a setpoint temperature.

5. A side-by-side refrigerator in accordance with claim 1 further comprising at least one third duct in a center portion of said center mullion wall, said third duct in flow communication with said food storage portion of said freezer compartment and said fresh food compartment.

6. A side-by-side refrigerator in accordance with claim 5 further comprising a damper located in said third duct.

7. A side-by-side refrigerator in accordance with claim 6 wherein said damper in said third duct in said center mullion wall center portion is a manually set type damper.

8. A side-by-side refrigerator in accordance with claim 1 wherein said first duct is located within said center mullion wall.

9. A side-by-side refrigerator in accordance with claim 1 wherein said first duct is secured to a side surface of said center mullion wall.

10. A side-by-side refrigerator in accordance with claim 1 further comprising a damper located in said fresh food compartment port for controlling air flow through said port.

11. A side-by-side refrigerator having substantially constant spatial and temporal temperature control, the refrigerator comprising:

a freezer compartment comprising a food storage portion and an evaporator chamber comprising and inlet and an outlet;

a fresh food compartment; a center mullion wall separating said freezer compartment and said fresh food compartment;

a first duct in flow communication with said fresh food compartment port and said evaporator chamber, said first duct being in flow communication with said fresh food compartment port and said evaporator chamber, and said first duct being disposed so as to direct air passing from said fresh food compartment into said evaporator chamber in a downward direction from the top of said refrigerator so as to reduce convective air flow between said fresh food compartment and said evaporator chamber;

an auxiliary air control fan disposed to draw a suction on said fresh food compartment and discharge into said first duct so as to exhaust air into said evaporator chamber;

a lower second duct in a lower portion of said center mullion wall, said lower second duct in flow communication with said food storage portion of said freezer compartment and said fresh food compartment;

at least one third duct in a center portion of said center mullion wall, said third duct in flow communication with said food storage portion of said freezer compartment and said fresh food compartment; and a controller coupled to said auxiliary air flow control fan so as to control operation of said fan in correspondence with a sensed temperature in said fresh food compartment so as to provide substantially constant spatial and temporal temperature control in each of said fresh food and freezer compartments.

12. A side-by-side refrigerator in accordance with claim 11 further comprising a damper located in said lower second duct for controlling air flow therethrough.

13. A side-by-side refrigerator in accordance with claim 11 further comprising a temperature sensitive actuator coupled to said lower second duct damper for controlling a position of said damper based on sensed temperature.

14. A side-by-side refrigerator in accordance with claim 11 further comprising a damper located in said third duct.

15. A side-by-side refrigerator in accordance with claim 11 wherein said damper in said third duct in said center mullion wall center portion is a manually set type damper.

16. A side-by-side refrigerator in accordance with claim 11 further comprising a damper located in said fresh food compartment port for controlling air flow through said port.

* * * * *